US007302739B2

(12) United States Patent
Christiansson

(10) Patent No.: US 7,302,739 B2
(45) Date of Patent: Dec. 4, 2007

(54) DEVICE FOR FASTENING EMERGENCY EQUIPMENT TO A SHIP'S DECK

(75) Inventor: Tor Christiansson, Skeppshult (SE)

(73) Assignee: C M Hammar Utveckling AB, Vastra Frolunda (SE)

( * ) Notice: Subject to any disclaimer, the term of this patent is extended or adjusted under 35 U.S.C. 154(b) by 128 days.

(21) Appl. No.: 10/508,078

(22) PCT Filed: Apr. 22, 2003

(86) PCT No.: PCT/SE03/00642

§ 371 (c)(1),
(2), (4) Date: Sep. 16, 2004

(87) PCT Pub. No.: WO03/106258

PCT Pub. Date: Dec. 24, 2003

(65) Prior Publication Data

US 2005/0155194 A1 Jul. 21, 2005

(30) Foreign Application Priority Data

Apr. 23, 2002 (SE) ..... 0201237

(51) Int. Cl.
*F16G 11/00* (2006.01)

(52) U.S. Cl. ..... 24/136 R; 24/115 R

(58) Field of Classification Search ..... 24/69 TT, 24/69 T, 71 TT, 116 R, 68 CT, 68 TT, 136 R, 24/136 K, 136 L, 115 H, 115 K, 115 M, 24/115 R; 59/78, 84, 85, 93
See application file for complete search history.

(56) References Cited

U.S. PATENT DOCUMENTS 1,090,377 A * 3/1914 Blackburn ..... 24/136 K
1,355,004 A * 10/1920 Sandford ..... 24/136 K
1,511,917 A * 10/1924 Smith et al. ..... 24/68 TT
1,688,461 A * 10/1928 Hutton ..... 24/68 TT
2,130,040 A * 9/1938 Siler ..... 24/136 K
2,222,393 A * 11/1940 Benjamin ..... 24/116 R
3,595,097 A * 7/1971 Araya ..... 474/231
3,921,792 A * 11/1975 Anderson et al. ..... 198/851
4,265,134 A * 5/1981 Dupoyet ..... 474/231
4,272,952 A * 6/1981 Graham ..... 59/84
4,352,382 A * 10/1982 Weidler ..... 152/189
4,368,769 A * 1/1983 Rookasin ..... 24/68 TT (Continued)

FOREIGN PATENT DOCUMENTS

EP 1 193 172 A2 4/2002

*Primary Examiner*—James R. Brittain
*Assistant Examiner*—Ruth C. Rodriguez
(74) *Attorney, Agent, or Firm*—Harness, Dickey & Pierce, P.L.C.

(57) ABSTRACT

A device is for fastening emergency equipment to a ship's deck or to a structure on a ship's deck. The device includes a first and a second fastening facility for, respectively, a first external and a second external fastening device having, respectively, a first and a second tensile strength. The device further includes a third fastening facility for a third external fastening device having a third tensile strength. When the device is in operation, the second and the third fastening facility are mutually connected both by a connecting device incorporated in the device and by the first external fastening device. The connecting device incorporated in the device absorbs load between the second and the third fastening facility if the first external fastening device stops working.

18 Claims, 5 Drawing Sheets

U.S. PATENT DOCUMENTS 4,416,319 A * 11/1983 Hofmann ..... 24/68 TT
4,536,921 A * 8/1985 Brendel et al. ..... 24/132 WL
4,690,091 A 9/1987 Persbeck ..... 114/221 A
4,757,681 A * 7/1988 Matsuno et al. ..... 59/84
5,098,349 A * 3/1992 Wu ..... 474/206
5,367,798 A * 11/1994 Hughes ..... 37/399
5,507,671 A * 4/1996 Chadbourne et al. ..... 439/783
5,553,360 A * 9/1996 Lucas et al. ..... 24/136 K
5,913,670 A * 6/1999 Anderson et al. ..... 43/4.5
5,988,929 A * 11/1999 Doan ..... 403/281
6,161,372 A * 12/2000 Wehler ..... 59/78.1
6,898,827 B1 * 5/2005 Postelwait et al. ..... 24/136 L

* cited by examiner

DEVICE FOR FASTENING EMERGENCY EQUIPMENT TO A SHIP'S DECK

TECHNICAL FIELD

The present invention relates to a device for fastening emergency equipment, such as, for example, a life raft, to a ship's deck or to a structure on a ship's deck. The invention results in an increased life span for such devices, and a more rational production than with previous devices.

PRIOR ART

Various types of devices for fixing emergency equipment, for example life rafts, life buoys, radio transmitters, etc. to a ship's deck or a purpose-built structure on a ship's deck are previously known. The devices are often provided with some type of mechanism which releases the devices from the ship's deck if certain specific criteria are met which indicate the need to release the equipment, for example if the ship is about to sink or has met with some other kind of accident.

These previously known appliances have a number of deficiencies, for example they are difficult and hence expensive to make, since their production requires a large number of working moments.

Another drawback with known appliances is that they often comprise a number of rope eyelets, shackles and similar fastening devices, which must be connected to different places on the deck or structure, which can lead to faulty connections due to handling errors and resulting malfunction.

SUMMARY OF THE INVENTION

An object of the present invention is therefore to offer a device for fastening emergency equipment to a ship's deck or to a structure on a ship's deck, which device is simpler and hence cheaper to produce than known previous appliances. At the same time, an object of the present invention is to achieve a longer life than the life of previously known devices. Furthermore, the device according to the invention should not be prone to ageing phenomena to the same extent as previously known appliances, and should have a minimal scope for misconnection due to handling errors.

The aforementioned objects are achieved according to the present invention by means of a device for fastening emergency equipment to a ship's deck or to a structure on a ship's deck, comprising a first and a second fastening facility for external fastening means, which device further comprises a third fastening facility for external fastening means. The first and second fastening facilities are constituted by at least one opening in the device, with the device further comprising a connecting means which extends around said first and second fastening facilities, thereby also extending around fastening means which utilise said first and second facilities. Examples of emergency equipment for use with the device according to the invention are life rafts, life buoys, radio transmitters, Suitably, but not necessarily, the third fastening facility is constituted by a groove in the device, which groove extends around at least part of said first and second fastening facilities.

In addition, it is also suitable to let the first and the second fastening facilities be constituted by a first and a second opening respectively in the device, said openings being separate from one another in the device.

In one particular embodiment, said connecting means are constituted by a loop of a material extending around the second and the third fastening facility.

Also, said loop can preferably be integrated internally in the device.

In addition, the device may further comprise a sleeve, said sleeve comprising an opening, with the sleeve being attached to the device in operation in such a manner that the opening in the sleeve at least in part coincides with the first fastening facility. The sleeve is suitably arranged to be attached to the device by means of snap-attaching.

Because of this configuration, the device, in a manner to be explained in greater detail below, can be shaped to meet the demands placed upon it.

For example, the device becomes simple to make as the third fastening facility is constituted by a groove in the device.

DESCRIPTION OF FIGURES

The invention will be described in detail below with reference to the appended drawings, in which.

EMBODIMENTS

Figure 1:
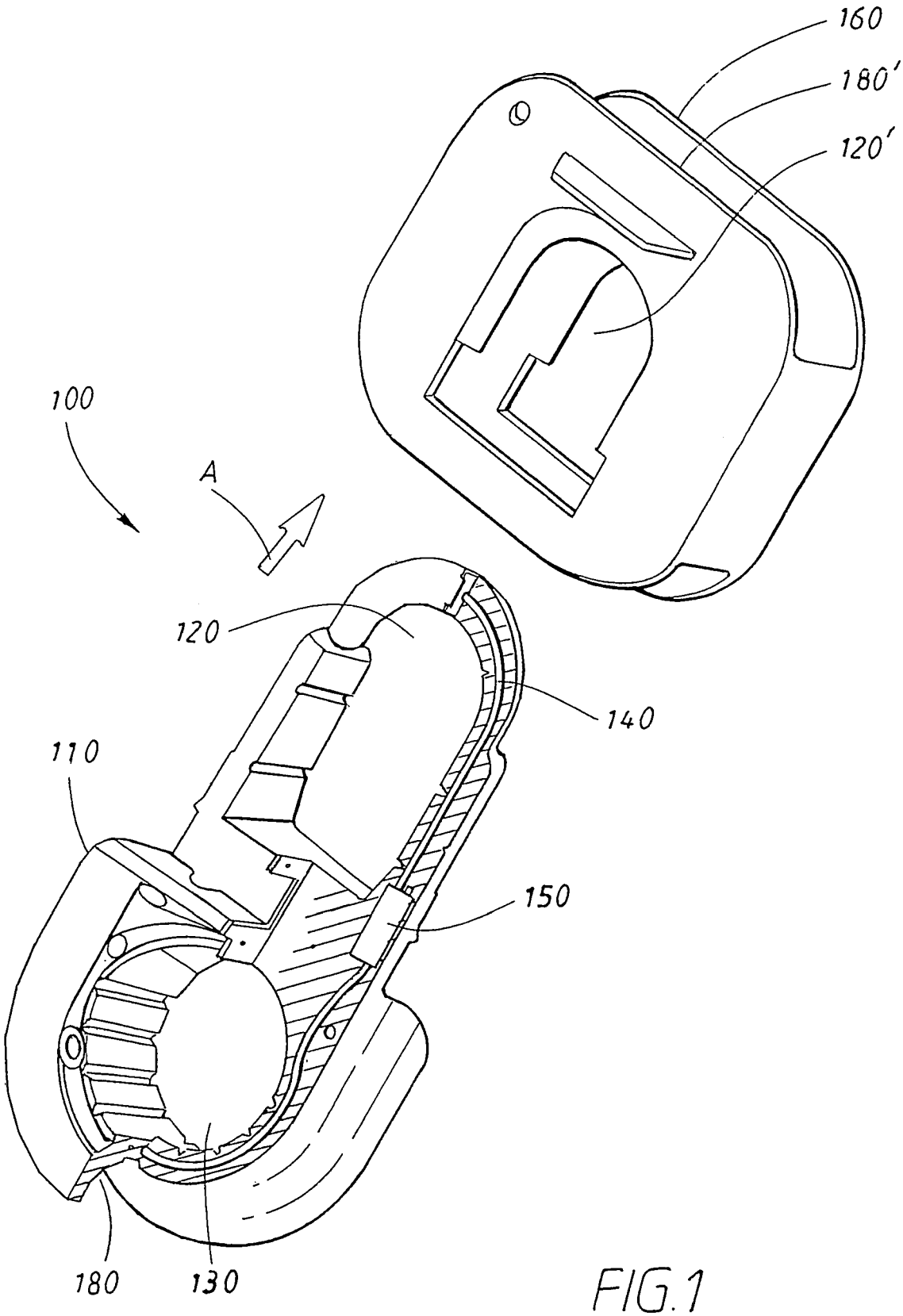
FIG. 1 shows the device according to the invention in dismantled state, with a part in sectional view.

FIG. 1 shows an example of an embodiment of a device 100 according to the present invention. The invention is primarily intended to be used for fastening emergency equipment such as for example life rafts, life buoys, radio transmitters, etc to a ship's deck or to a purpose-built structure on a ship's deck.

In the illustrated embodiment, the device 100 comprises a so-called shearing link 110, which, in the example is realised as a continuous link having a first 120 and a second opening 130, the workings of which will be seen in greater detail below, said two openings being separated from each other by a "cross-bar" in the device 100, thus giving the device a faint resemblance to the numeral "8".

The first and second openings serve as a first respectively a second fastening facility for external fastening means, in a manner which will be explained in greater detail below. As will be realized from the following explanation, the design of the first and seconds fastening facilities in the device 100 as two separate openings in the device is not necessary, the two fastening facilities can also, for example, be designed as one continuous opening ion the device 100.

The shearing link 110 further comprises a means 140 for connecting the two openings or fastening facilities 120, 130 in the device 100. In the example, this connecting means 140 is realised as a stainless steel wire, which is closed with a lock 150, in the example a so-called pressed talurite lock. The connecting means 140 extends around the second 120 and third 130 fastening facility, i.e. the two openings in the shearing link, and will thus also extend around and connect any fastening means which are fastened to the fastening facilities 120, 130.

The important aspect of the invention is not, however, the exact implementation of the connecting means, but an important aspect is that the connecting means can be given a well defined strength, for reasons which will be set out in greater detail below.

One example of how the shearing link can be made is for it to be realised as an injection-moulded plastics part, having the connecting means or openings 120 130 moulded into the plastic, together with the cross-bar which separates them from each other. This is only one example, however; the shearing link can, of course, be realised in a large number of other ways, the important aspect is that the working which is described here is maintained.

The device of the invention, still depicted as a shearing link 110 further comprises a third fastening facility 180 for external fastening means, said third fastening facility suitably being in the form of a groove 180, which runs around the whole or parts of the circumference of the device or shearing link 110, on its outside, and at least in part encloses or extends around the two openings 120, 130. The purpose of the third fastening means 180, i.e. the groove, will also be seen in greater detail below.

The device according to the invention can also comprise a casing or a sleeve 160. This sleeve 160 comprises an opening 120' and, in a conceivable configuration, can be seen as two plates, which each have a through-hole in the middle and which are held together by two walls, each extending between opposite outer edges of the plates. The casing will then, in addition to the opening 120', also have a through-opening in the direction defined by the arrow A in FIG. 1.

The sleeve or casing 160 is designed to be slipped onto the device or in this embodiment shearing link so that the sleeve constitutes protection for at least that part of the shearing link which comprises the one opening 120, the sleeve being held in place on the device by means of snap-fastening, for example. The fact that protection for part of the device is constituted by the sleeve 160, which is a separate part, offers a number of advantages, the sleeve can for example be replaced more easily than an integrated part, where necessary, if it is worn. Another advantage is that one and the same shearing link construction can be used for different applications, in which the sleeve can be the part which is modified according to the needs of the particular application, for example in terms of strength, colour, etc. The possibility of configuring the protection as a sleeve which can be given shape and colour as required means that the construction can be modified according to different requirements in different applications with different colour coding.

When attached to the device 100, the opening 120' of the sleeve will, due to the design, at least in part coincide with the first fastening facility 120, this enabling that fastening facility to be used as intended.

Figure 2:
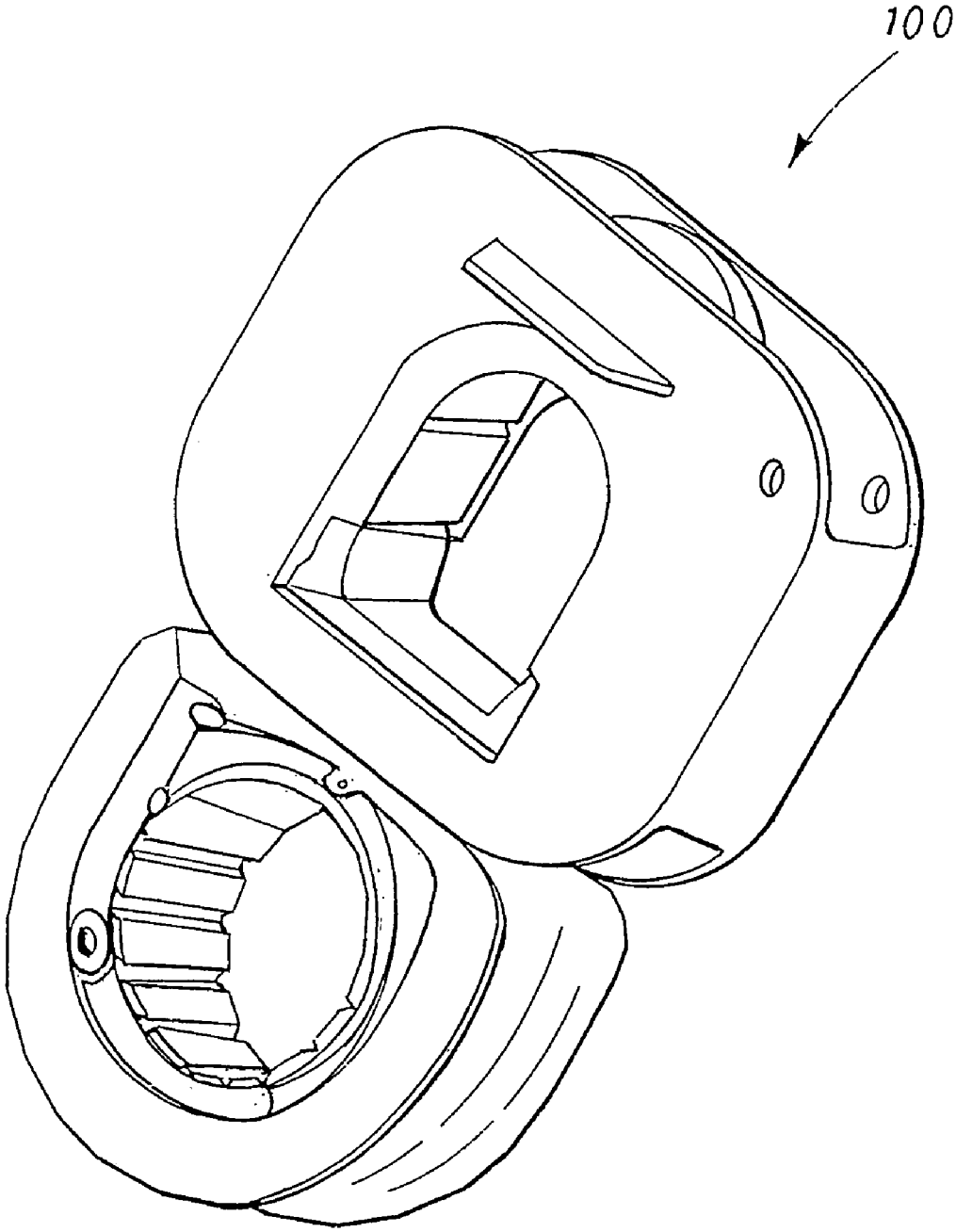
FIG. 2 shows the device from FIG. 1, in an assembled state.

FIG. 2 shows a device 100 according to the invention in assembled state, in other words with the sleeve 160 slipped onto the main part of the invention, i.e. the shearing link 110. As can be seen from FIG. 2, the opening 120' in the casing 160 coincides at least in part with one of the fastening facilities 120, 130 in the shearing link, so that the assembled device 100 can be given a total of two such facilities, in which the one facility is defined by the opening in the casing 120' coinciding at least partly with one other opening 120 in the shearing link.

The fastening facility in the device 100 which is defined by the opening 120' in the casing 160, because of the facility to give the casing a colour different from the shearing link, will be easily identifiable by a user, which means that the chance of mistaking the two fastening facilities during use of the device 100 is diminished, which, in turn, reduces the risk of the-device being wrongly coupled.

Of course, the number of fastening facilities in the shearing link 110 and the sleeve 160 is only an example, it is understood that a device according to the invention can be configured with a largely arbitrary number of such facilities, which can be divided, in principle arbitrarily, between fastening facilities 120 in the shearing link which are enclosed by the sleeve and coincide with the openings 120' of the sleeve, and the fastening facilities 130 in the shearing link which are not enclosed by the sleeve.

As stated above, the sleeve 160 has "walls", which, when the sleeve is slipped onto the shearing link, will form a protective wall and guidance for fastening means 170, for example in the form of a rope, which are placed in the third fastening facility or groove 180, as will be seen in greater detail below.

Figure 3:
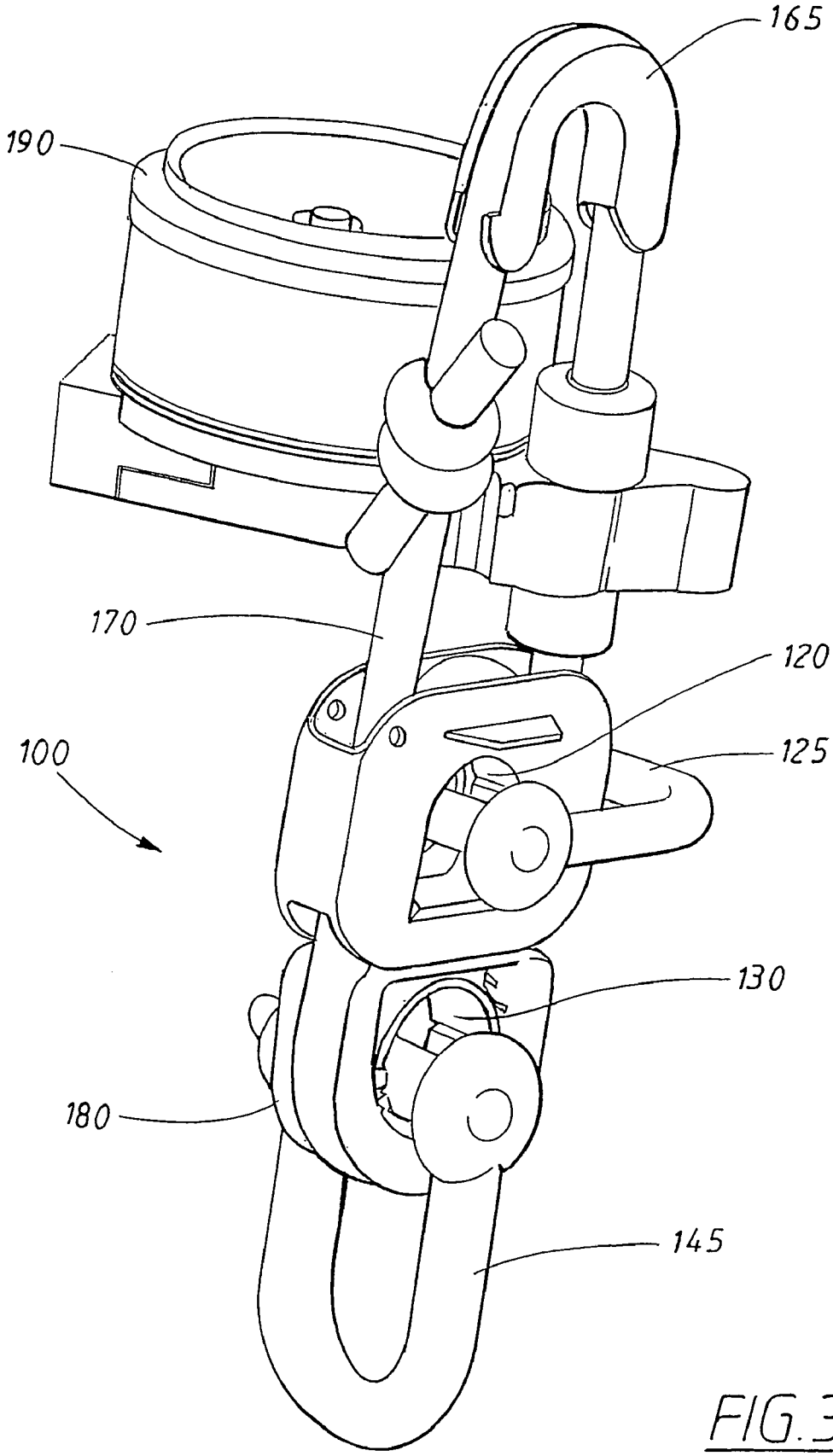
FIG. 3 shows the device as it will appear in operation.

FIG. 3 shows the device 100 in operation. A first and a second external point, in the form of a shackle 145 and a so-called thimble 165, are mutually connected by means of the device 100 as follows: the shackle 145 is connected to the device 100 via the second fastening facility, the opening 130, and the thimble 165 is connected to the device 100 via a rope end 170 which passes into the groove 180, within the walls of the sleeve 160.

The shackle can be used for connection to a ship's deck (not shown) or a structure in a ship's deck for fixing of emergency equipment, for example a life raft, and the thimble can used for connection to a line or a shackle which passes around the life raft and is connected to another point in the ship's deck. A life raft can thus be fixed to a ship's deck, for example, by means of the device and respectively a first 170 and a second 145 external fastening means which utilize the first and second fastening facilities (i.e. the openings in this embodiment) of the device, respectively.

The rope end 170 connecting the thimble 165 to the device extends in the above-described groove 180 in the device, passes around the thimble 165 and additionally passes around at least a part of the -shearing link which encloses the second fastening facility 130 in the device. The rope end can additionally run through a device 190 for releasing the life raft, in the illustrated example a hydrostat with a built-in knife which cuts off the rope end at a certain predefined pressure. The working of the device 190 is not of primary interest for the invention, and will thus not be described in further detail here.

Via the first fastening facility 120 in the device 100, a third external fastening means 125, in the form of a further shackle, is additionally fixed. Expediently, this shackle 125, in addition to its connection to the device 100, is fastened in a so-called "painter line", a release line, the working of which is familiar to the person skilled in the art and which will therefore not be described in greater detail here. This "painter line" is usually fastened with slack, so that it does not absorb any force when the device is operating, if the rope end 170 is under strain.

As described above in connection with FIG. 1, the device comprises a connecting means, in an advantageous embodiment in the form of a wire 140, which extends around the two fastening facilities 120, 130 so that the two shackles 125, 145 will be mutually connected by this second connecting means 140. Since the strain in the fixing of the life raft via the device 100 will normally be absorbed by the rope end 170, the connecting means, the wire 140 will not be strained during operation.

In order to facilitate understanding of the application for a device 100 according to the invention, a possible process with a life raft will be described:

The life raft is fixed in the ship's deck by means of a device according to the invention, in the manner depicted in FIG. 3. If the ship sinks, the hydrostat 190 will be activated at a certain predefined depth, whereupon the built-in knife cuts off the rope end 170. The connection between the ship's deck and the life raft breaks and the life raft begins to float to the surface. However, the life raft is still fixed in the "painter line", via the shackle 145 and the shackle 125, which are still fixed together by means of the wire 140. At a certain predefined depth, the "painter line" will also be stretched, whereupon the shackles 125, 145 begin straining the wire 140, whereby the life raft is opened and inflated. The wire 140 will break once its tensile strength has been exceeded. Expediently, the wire has a tensile strength which is less than that of the rope end 170, but this can, of course, be varied within the scope of the invention, depending on the particular application.

Figure 4:
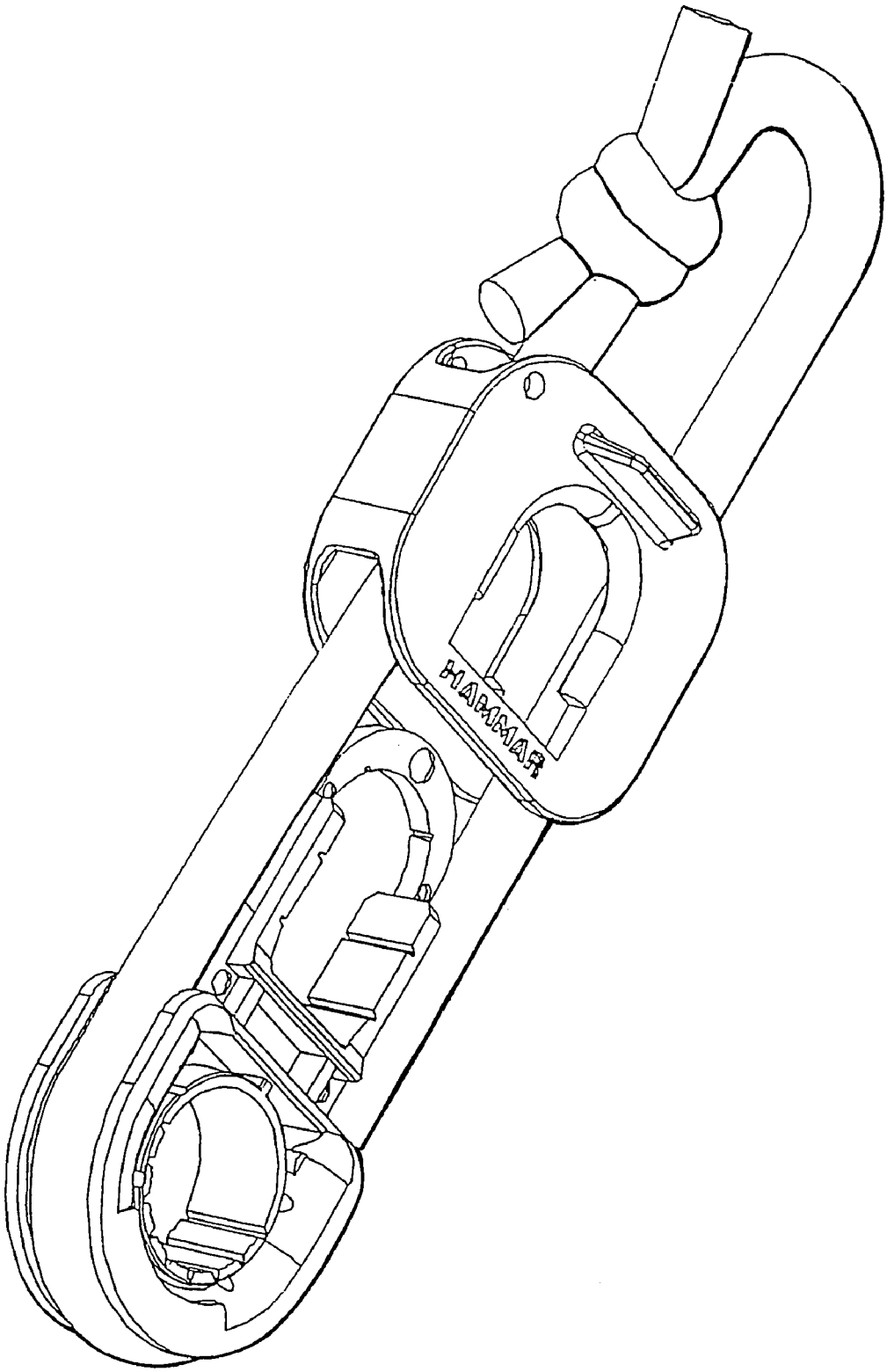
FIGS. 4 and 5 show a step in the assembly of a device according to the invention.
Figure 5:
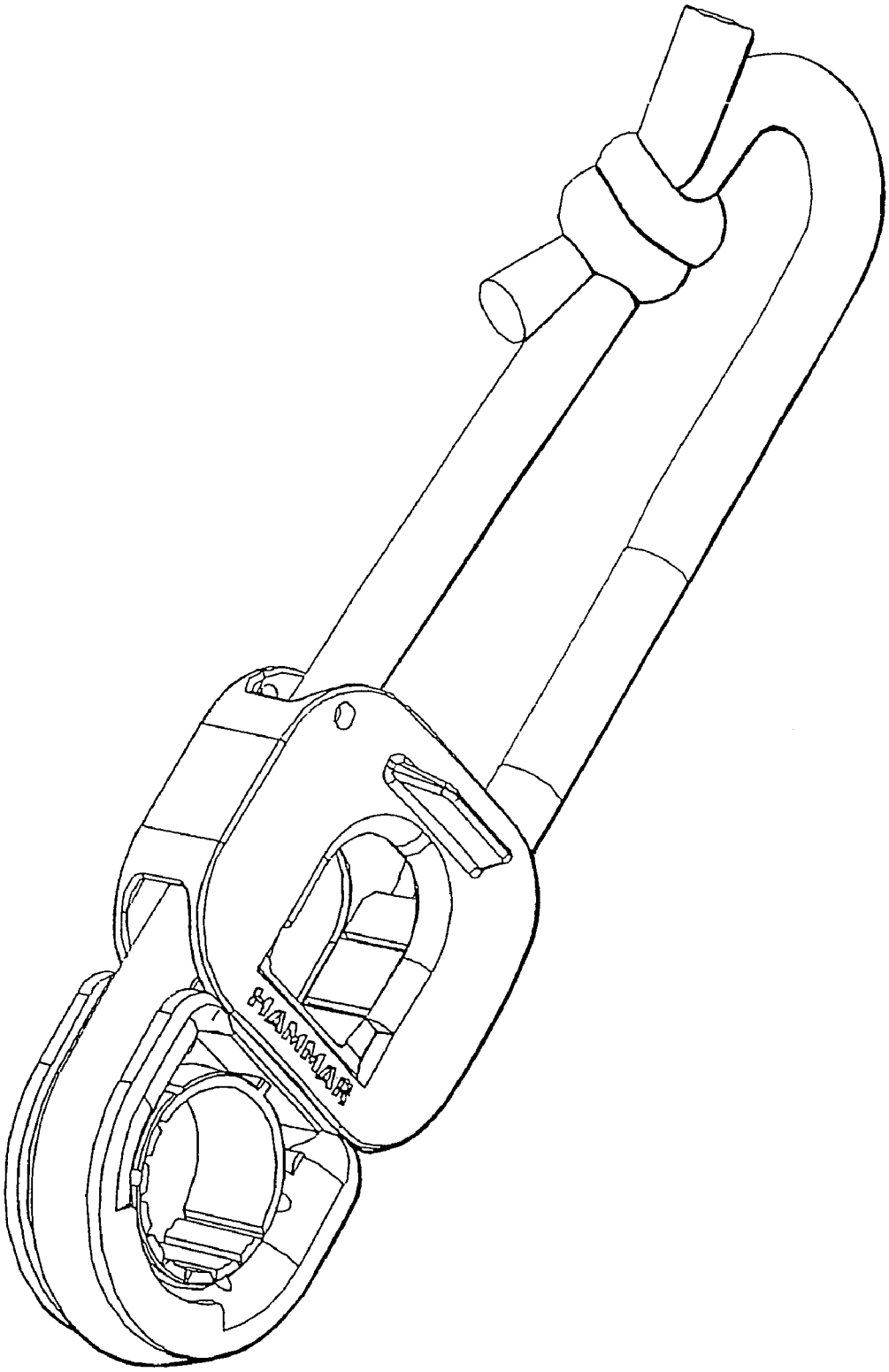

FIG. 4 shows how a device according to the invention can be put together: the rope end 170 has been slipped around a part of the shearing link 110, in its groove 180. The rope end has further been slipped into the casing 160, within the aforementioned walls of the casing. Expediently, the rope end is knotted and is arranged next to an external device, such as the hydrostat, before the rope end is placed in the device 100, but can also be knotted subsequently.

Once the rope end has been placed in this way around the groove 180 in the device, the device can then be assembled in the manner previously described, namely by the casing 160 being put together with the shearing link 110 by the casing being slipped onto the shearing link and secured, for example, by snap-fastening.

The invention is not limited to the embodiment described above, but can be freely modified within the scope of the following patent claims. One parameter which, for example, might be modified within the scope of the invention is the tensile strength of the wire in the shearing link, and hence the relationship between the strengths in the shearing link and the rope end employed in the use of the device.

The invention claimed is:

1. A device for fastening emergency equipment to at least one of a ship's deck and a structure on a ship's deck, comprising:

a shearing link including a first fastening facility and a second fastening facility for second and third external fasteners;

a third fastening facility for a first external fastener, wherein the first and the second fastening facilities are constituted by at least one opening in the shearing link; and a connector, extending around said first and said second fastening facilities, said connector thereby also mutually connecting said second and said third external fasteners which utilize said first and said second fastening facilities, wherein the connector is arranged with a tensile strength that allows breaking of the connector once its tensile strength has been exceeded by strain caused by the second and third external fasteners in the absence of the first external fastener; and a sleeve, said sleeve comprising an opening, with the sleeve being attached to the device in operation in such a manner that the opening in the sleeve at least in part coincides with the first fastening facility, wherein the sleeve is arranged to be attached to the device via snap-attaching.

2. The device according to claim 1, wherein the first and the second fastening facilities are constituted by a first opening and a second opening respectively in the device, said openings being separate from one another in the device.

3. The device according to claim 2, wherein said connector includes a loop of a material extending around the second and the third fastening facilities.

4. The device according to claim 1, wherein said connector includes a loop of a material extending around the second and the third fastening facilities.

5. The device of claim 4, wherein said loop is integrated internally in the device.

6. The device of claim 3, wherein said loop is integrated internally in the device.

7. The device of claim 4, wherein the loop of material is a wire.

8. The device of claim 1, in which the third fastening facility is constituted by a groove in the device, the groove extending around at least part of the first and the second fastening facilities.

9. The device according to claim 1, wherein the first external fastener is placed in the third fastening facility.

10. The device of claim 1, wherein the strain in the fixing of the emergency equipment via the device is absorbed by the first external fastener, wherein the connector will not be strained during the operation.

11. The device of claim 1, wherein the first external fastener is a rope end.

12. A device for fastening emergency equipment to at least one of a ship's deck and a structure on a ship's deck, comprising:

a shearing link including a first fastening facility and a second fastening facility for second and third external means for fastening;

a third fastening facility for first external means for fastening, wherein the first and the second fastening facilities are constituted by at least one opening in the device; and connecting means, extending around said first and said second fastening facilities, for mutually connecting said second and said third external means for fastening which utilize said first and said second fastening facilities, wherein the connecting means is arranged with a tensile strength that allows breaking of the connecting means once its tensile strength has been exceeded by strain caused by the second and the third external means for fastening in the absence of the first external means for fastening; and a sleeve, said sleeve comprising an opening, with the sleeve being attached to the device in operation in such a manner that the opening in the sleeve at least in part coincides with the first fastening facility, wherein the sleeve is arranged to be attached to the device via snap-attaching.

13. The device according to claim 12, wherein the first and the second fastening facilities are constituted by a first and a second opening respectively in the device, said openings being separate from one another in the device.

14. The device according to claim 12, wherein said connecting means includes a loop of a material extending around the second and the third fastening facility.

15. The device of claim 14, wherein said loop is integrated internally in the device.

16. A device for fastening emergency equipment to at least one of a ship's deck and a structure on a ship's deck, comprising:

a shearing link including a first fastening facility and a second fastening facility for second and third external fasteners;

a third fastening facility for a first external fastener, wherein the first and the second fastening facilities are constituted by at least one opening in the shearing link; and a connector, extending around said first and said second fastening facilities, said connector thereby also mutually connecting said second and said third external fasteners which utilize said first and said second fastening facilities, wherein the connector is arranged with a tensile strength that allows breaking of the connector once its tensile strength has been exceeded by strain caused by the second and third external fasteners in the absence of the external fastener, wherein the first external fastener is placed in the third fastening facility and wherein the device comprises a cutting device arranged to cut off the first external fastener.

17. The device according to claim 16, wherein the cutting device is comprised in a hydrostat arranged to be activated at a certain predefined depth.

18. A device for fastening emergency equipment to at least one of a ship's deck and a structure on a ship's deck, comprising:

a shearing link including a first fastening facility and a second fastening facility for second and third external fasteners;

a third fastening facility for a first external fastener, wherein the first and the second fastening facilities are constituted by at least one opening in the shearing link; and a connector, extending around said first and said second fastening facilities, said connector thereby also mutually connecting said second and said third external fasteners which utilize said first and said second fastening facilities, wherein the connector is arranged with a tensile strength that allows breaking of the connector once its tensile strength has been exceeded by strain caused by the second and third external fasteners in the absence of the external fastener, wherein the first external fastener is a rope end and wherein the connector has a tensile strength which is less than that of the rope end.

* * * * *